US011910982B2

(12) United States Patent
Cooke et al.

(10) Patent No.: US 11,910,982 B2
(45) Date of Patent: Feb. 27, 2024

(54) RECYCLABLE AUTO-DOSING CONTAINER

(71) Applicant: Conopco Inc., Englewood Cliffs, NJ (US)

(72) Inventors: Deborah Jane Cooke, Bebington (GB); David Moorfield, Bebington (GB)

(73) Assignee: Conopco Inc., Englewood Cliffs, NJ (US)

( * ) Notice: Subject to any disclaimer, the term of this patent is extended or adjusted under 35 U.S.C. 154(b) by 0 days.

(21) Appl. No.: 17/770,377

(22) PCT Filed: Oct. 15, 2020

(86) PCT No.: PCT/EP2020/079064

§ 371 (c)(1),
(2) Date: Apr. 20, 2022

(87) PCT Pub. No.: WO2021/083678

PCT Pub. Date: May 6, 2021

(65) Prior Publication Data

US 2022/0386846 A1 Dec. 8, 2022

(30) Foreign Application Priority Data

Nov. 1, 2019 (EP) ..... 19206792
Nov. 1, 2019 (EP) ..... 19206797

(51) Int. Cl.
*A47L 15/44* (2006.01)
*D06F 39/02* (2006.01)

(52) U.S. Cl.
CPC ..... *A47L 15/4418* (2013.01); *D06F 39/022* (2013.01)

(58) Field of Classification Search
CPC .... D06F 39/022; D06F 33/37; D06F 2105/42; D06F 39/02; A47L 15/4445;
(Continued)

(56) References Cited

U.S. PATENT DOCUMENTS 567,163 A 8/1896 Pickens
3,094,247 A 6/1963 Marchi
(Continued)

FOREIGN PATENT DOCUMENTS

AU 13548 9/1988
CN 101298733 11/2008
(Continued)

OTHER PUBLICATIONS

Zhang et al., "Liquid consumable feeding device and dish washing machine", Jul. 2019, CN-209091297-U machine translation (Year: 2019).*

(Continued)

*Primary Examiner* — David G Cormier
*Assistant Examiner* — Thomas Bucci
(74) *Attorney, Agent, or Firm* — N.V. Nederlandsch Octrooibureau

(57) ABSTRACT

A recyclable container containing a substrate treatment liquid, configured for fluid connection to a fluid communication system of a substrate treatment machine e.g. washing machine, the storage container comprising:

Figure 1:
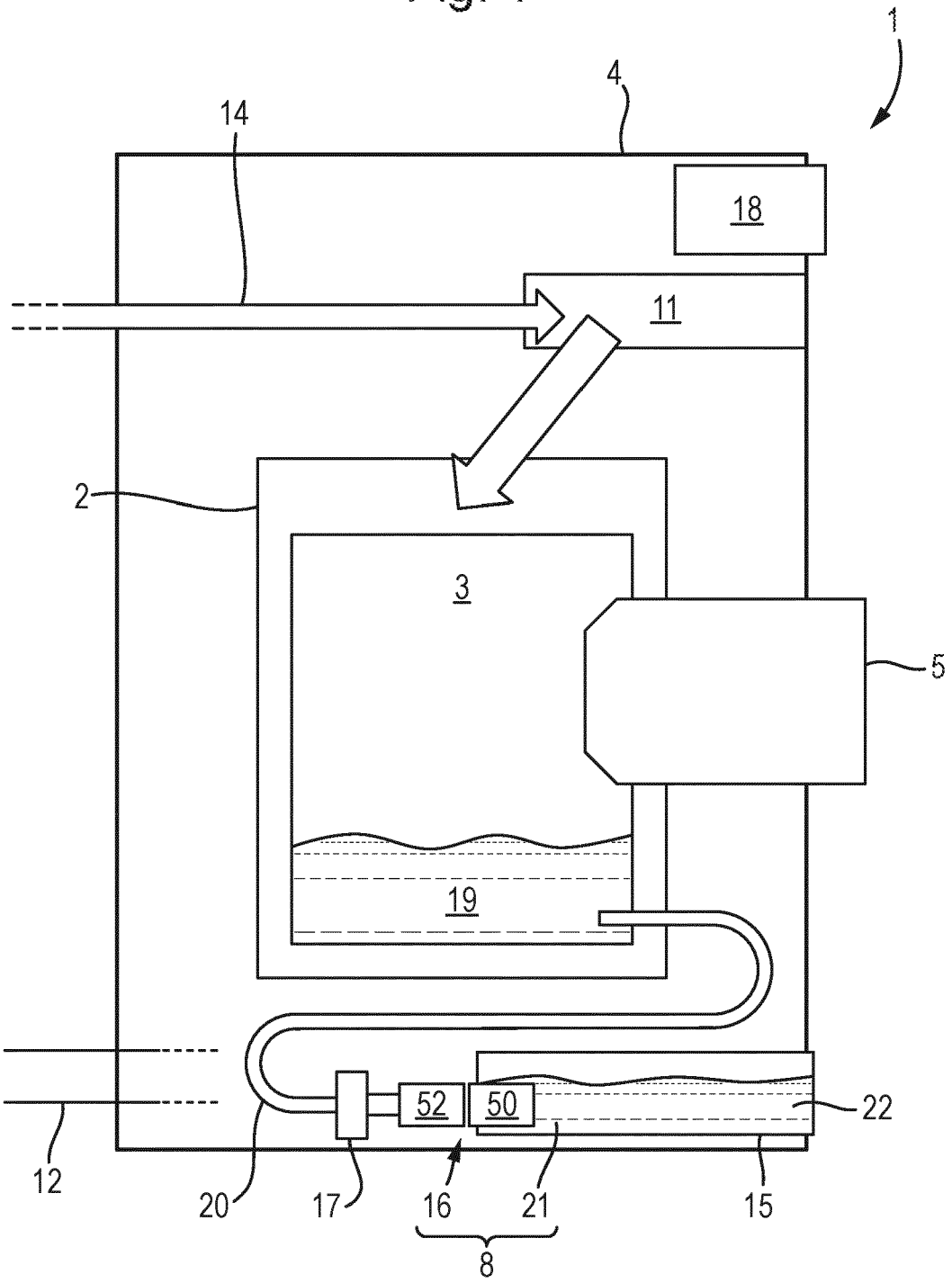

(i) a reservoir containing a multi-dose stock of the substrate treatment liquid;

(ii) a container connector which is designed to be removably and fluidly connectable with a machine connector of the substrate treatment machine, said connectors together forming a container-machine connection, such that the substrate treatment liquid can controllably flow from the reservoir via the container-machine connection to said fluid communication system; and (iii) a valve which is movable between an open and a closed position to control the flow of substrate treatment liquid from the storage container, said valve comprising a biasing member such that the valve is biased toward an open or closed position within the housing; and (Continued)

wherein the reservoir, container connector and valve comprise a recyclable plastic and that the biasing member comprises a recyclable plastic having a shore A hardness of 30-95 degrees, preferably 40-90 degrees, more preferably 45-85 degrees.

12 Claims, 4 Drawing Sheets

(58) Field of Classification Search
CPC .. A47L 15/4463; A47L 15/4418; A47L 15/44; A47L 15/449
USPC ..... 134/57 D
See application file for complete search history.

(56) References Cited

U.S. PATENT DOCUMENTS 3,871,422 A 3/1975 Elson et al.
4,009,253 A 2/1977 Schleppnik et al.
4,187,251 A 2/1980 Schleppnik
4,719,105 A 1/1988 Schleppnik
4,932,227 A 12/1990 Hogrefe
5,441,727 A 8/1995 Chatterjee et al.
5,556,005 A * 9/1996 Banks ..... A47K 5/1204 222/105
5,743,432 A 4/1998 Barbe
5,861,371 A 1/1999 Wilsch-Irrgang
5,897,671 A 4/1999 Newman et al.
5,942,485 A 8/1999 Kemen
5,974,303 A 10/1999 Krause
6,102,517 A 8/2000 Kobayashi
6,206,282 B1 3/2001 Hayers, Sr. et al.
6,349,440 B1 2/2002 Amberg et al.
8,631,972 B2 1/2014 Kessler et al.
9,469,933 B2 10/2016 Miller
9,949,612 B2 4/2018 Lonski
10,240,274 B2 3/2019 Miller
2001/0049846 A1 12/2001 Guzzi et al.
2002/0077265 A1 6/2002 Buzzacarini et al.
2002/0139816 A1* 10/2002 Powling ..... B05B 11/1098 222/341
2002/0161460 A1 10/2002 Noguchi
2003/0075237 A1 4/2003 Bettiol et al.
2003/0154560 A1 8/2003 Behrens et al.
2003/0216274 A1 11/2003 Del Duca et al.
2004/0147416 A1 7/2004 Woo et al.
2005/0033647 A1 2/2005 Crisp, III
2005/0102767 A1 5/2005 Aouad et al.
2005/0106192 A1 5/2005 Parekh
2005/0113282 A1 5/2005 Parekh et al.
2006/0102656 A1 5/2006 Troost et al.
2006/0138169 A1 6/2006 Cafferty
2006/0272360 A1 12/2006 Hsu et al.
2007/0044819 A1 3/2007 Chan et al.
2007/0044820 A1 3/2007 Chan et al.
2008/0210702 A1 9/2008 Lochinger
2008/0276655 A1 11/2008 Luckman et al.
2008/0276964 A1 11/2008 Hendrickson et al.
2008/0276965 A1 11/2008 Aykroyd et al.
2009/0044129 A1 2/2009 Ebrom et al.
2009/0044137 A1 2/2009 Bartley et al.
2009/0194562 A1 8/2009 Kessler et al.
2009/0276101 A1 11/2009 Yankee et al.
2010/0032437 A1 2/2010 Lossau
2010/0059550 A1* 3/2010 Ciavarella ..... A47K 5/1207 222/325
2010/0102076 A1 4/2010 Hendrickson et al.
2010/0102082 A1 4/2010 Ebrom et al.
2010/0132748 A1 6/2010 Kessler et al.
2010/0163573 A1 7/2010 Wegelin et al.
2011/0139818 A1 6/2011 Kessler et al.
2011/0154864 A1 6/2011 Schulze
2011/0174346 A1 7/2011 Kessler et al.
2011/0225106 A1 9/2011 Levenstein et al.
2011/0290281 A1 12/2011 Kessler et al.
2011/0315709 A1 12/2011 Fileccia et al.
2012/0015858 A1 1/2012 Kessler et al.
2012/0018451 A1* 1/2012 Fileccia ..... A47L 15/4463 222/129
2012/0021965 A1 1/2012 Bastigkeit et al.
2012/0031930 A1 2/2012 Feliccia et al.
2012/0088710 A1 4/2012 Kessler et al.
2012/0204356 A1 8/2012 Bastigkeit et al.
2012/0247158 A1 10/2012 Ditze et al.
2012/0247565 A1 10/2012 Livingston et al.
2012/0088709 A1 12/2012 Kessler et al.
2012/0305605 A1* 12/2012 Vassaux ..... B67D 1/0037 251/129.01
2013/0036775 A1 2/2013 Brueckner et al.
2013/0042652 A1 2/2013 Brueckner et al.
2013/0061404 A1 3/2013 Jenkins
2013/0263387 A1 10/2013 Aykroyd et al.
2013/0263630 A1 10/2013 Doh et al.
2013/0340178 A1 12/2013 Riesenberg et al.
2014/0102153 A1 4/2014 Lee et al.
2015/0330013 A1 11/2015 Miller
2015/0368846 A1 12/2015 Del Pos et al.
2015/0375900 A1 12/2015 Larson
2016/0060800 A1 3/2016 Ghosh et al.
2016/0289883 A1 10/2016 Lv et al.
2017/0081616 A1 3/2017 Baltsen et al.
2017/0107658 A1 4/2017 Bolton et al.
2018/0171531 A1 6/2018 Miller
2018/0289222 A1* 10/2018 Nilsson ..... A47K 5/1209
2019/0003104 A1 1/2019 Shu et al.
2019/0136162 A1 5/2019 Cooke et al.
2019/0136439 A1 5/2019 Cooke
2019/0136440 A1 5/2019 Clarke
2019/0264364 A1 8/2019 Chatfield
2019/0292710 A1 9/2019 Cooke

FOREIGN PATENT DOCUMENTS

CN 101302697 11/2008
CN 101886323 11/2010
CN 101886324 11/2010
CN 201780584 3/2011
CN 102571129 7/2012
CN 102883645 1/2013
CN 202744828 2/2013
CN 203034258 7/2013
CN 103485122 1/2014
CN 204211975 3/2015
CN 104805649 7/2015
CN 205258897 5/2016
CN 106192308 12/2016
CN 106988076 7/2017
CN 107268234 10/2017
CN 107622315 1/2018
CN 209091297 U 7/2019
CN 209091297 U * 7/2019 ..... A47L 15/4418
DE 744406 1/1944
DE 4414956 11/1994
DE 102007041643 3/2009
DE 102008047941 3/2010
DE 102009046546 5/2011
DE 10201003776 10/2011
DE 102010028353 11/2011
DE 102010027993 5/2012
DE 102013018175 6/2015
DE 102016212981 1/2018
DE 102016212982 1/2018
EP 0172511 2/1986
EP 0299575 1/1989
EP 0368680 5/1990
EP 0387426 9/1990
EP 1041187 10/2000
EP 1088927 4/2001
EP 1317524 6/2003
EP 1318225 6/2003
EP 1468926 10/2004
EP 1212398 6/2006

(56) References Cited

FOREIGN PATENT DOCUMENTS

| | | | | |
|---|---|---|---|---|
| EP | 1728912 | | 6/2006 | |
| EP | 1731654 | | 12/2006 | |
| EP | 1995368 | | 11/2008 | |
| EP | 2065860 | | 6/2009 | |
| EP | 2141275 | | 1/2010 | |
| EP | 2314542 | | 4/2011 | |
| EP | 2581486 | | 4/2013 | |
| EP | 2642013 | | 9/2013 | |
| EP | 2913431 | | 9/2015 | |
| EP | 2939975 | | 11/2015 | |
| EP | 2955150 | | 12/2015 | |
| EP | 3130968 | | 2/2017 | |
| EP | 3176298 | | 6/2017 | |
| ES | 2446248 | | 11/2013 | |
| FR | 2612894 | | 9/1988 | |
| GB | 2437555 | | 9/2008 | |
| GB | 2468158 | | 9/2010 | |
| KR | 20100081221 | | 7/2010 | |
| WO | WO9115623 | | 10/1991 | |
| WO | WO9527037 | | 10/1995 | |
| WO | 9621387 | A1 | 7/1996 | |
| WO | WO9709406 | | 3/1997 | |
| WO | WO0107095 | | 2/2001 | |
| WO | WO0196645 | | 12/2001 | |
| WO | WO0208371 | | 1/2002 | |
| WO | WO0220893 | | 3/2002 | |
| WO | WO2004101122 | | 11/2004 | |
| WO | WO2008008392 | | 1/2008 | |
| WO | WO2008016683 | | 2/2008 | |
| WO | WO2008074680 | | 6/2008 | |
| WO | WO2009022223 | | 2/2009 | |
| WO | WO2009033828 | | 3/2009 | |
| WO | WO2009094999 | | 8/2009 | |
| WO | WO2009095003 | | 8/2009 | |
| WO | WO2009153184 | | 12/2009 | |
| WO | WO2010031607 | | 3/2010 | |
| WO | WO2010067303 | | 6/2010 | |
| WO | WO2011042867 | | 4/2011 | |
| WO | 2011084603 | A1 | 7/2011 | |
| WO | WO-2011084603 | A1 * | 7/2011 | ..... B67D 1/0005 |
| WO | WO2011128676 | | 10/2011 | |
| WO | WO2011131256 | | 10/2011 | |
| WO | WO2011134690 | | 11/2011 | |
| WO | WO2011138218 | | 11/2011 | |
| WO | WO2012084005 | | 6/2012 | |
| WO | WO2012118285 | | 9/2012 | |
| WO | WO2013054089 | | 4/2013 | |
| WO | WO2014031753 | | 2/2014 | |
| WO | WO2014079621 | | 5/2014 | |
| WO | WO2016173679 | | 11/2016 | |
| WO | WO2017042087 | | 3/2017 | |
| WO | WO2017067936 | | 4/2017 | |
| WO | WO2017205280 | | 11/2017 | |
| WO | WO2017176292 | | 12/2017 | |
| WO | WO2017211698 | | 12/2017 | |
| WO | WO2017211700 | | 12/2017 | |
| WO | WO2017211701 | | 12/2017 | |
| WO | WO2018011167 | | 1/2018 | |
| WO | WO2018011179 | | 1/2018 | |
| WO | 2018177517 | A1 | 10/2018 | |
| WO | WO-2018177517 | A1 * | 10/2018 | ..... A47K 5/1205 |
| WO | WO2019149707 | | 8/2019 | |

OTHER PUBLICATIONS

Spruce App; Spruce App; 2019; pp. 1-12 (https://www.thespruce.com/there-is-an-app-for-laundry-2146366).

Clorox My Stain App; Clorox My Stain App; 2020; pp. 1-3 https://play.google.com/store/apps/details?id=net.clorox2.mystain&hl=en_US.

Apps for Dry Clearners; Apps for Dry Cleaners; 2020; pp. 1-2, dlionline.org/apps.

VeryWear App STAIN; VeryWear App STAIN; 2020; pp. 1-4, https://appadvice.com/app/the-stain/510901231.

AEG, My AEG Care App; AEG, My AEG Care App; 2020; pp. 1-10, https://www.aeg.co.uk/about-aeg/connectivity-hub/#732729.

Hoover, Hoover Wizard App; Hoover, Hoover Wizard App; 2020; pp. 1-6, http://www.hooveronetouch.com/gb/index.html.

Candy Smart Touch App; Candy Smart Touch App; 2020; http://www.candysmarttouch.com/eu/index.html.

Samsung, SmartThings Classic App; Samsung, SmartThings Classic App; 2020; https://play.google.com/store/apps/details?id=com.smartthings.android&hl=en.

* cited by examiner

RECYCLABLE AUTO-DOSING CONTAINER

Auto-dosing substrate treatment machines e.g. washing machines, offer great benefits for the consumer in terms of convenience.

Auto-dosing substrate treatment machines generally comprise a multi-dose reservoir of treatment product from which doses are automatically dispensed under control of the machine. Systems can utilize refillable multi-dose reservoirs which are removable (e.g. for ease of refilling and/or cleaning) or these may be provided as pre-filled multi-dose reservoirs which are removed when empty and then replaced with another pre-filled reservoir.

However, most systems are still not optimized for recycling. The difficulty is that the reservoirs must be multifunctional. They must be sufficiently sturdy and have volume to contain multiple doses of formulations and withstand contact with bleach/aggressive cleaning chemicals. Removable reservoirs must also be connectable and disconnectable to the washing machines fluid communication lines. The reservoir must dispense, on command from the washing machine control system, doses of the contained formulation. Such multifunctional requirements often dictate that container designs use a mixture of materials, such as metal and plastic, and in many cases the materials are not easily separated which inhibits recycling. For example components of one material may be bound up with or held captive within a structure comprised of a different, incompatible (from the point of view of recycling) material. This can prevents or at least reduces full recovery all the reservoir materials.

Despite the prior art there is a need for improved substrate containers for auto-dosing washing machines.

In one aspect the invention provides a recyclable container containing a substrate treatment liquid, configured for fluid connection to a fluid communication system of a substrate treatment machine e.g. washing machine, the storage container comprising:

(i) a reservoir containing a multi-dose stock of the substrate treatment liquid;

(ii) a container connector which is designed to be removably and fluidly connectable with a machine connector of the substrate treatment machine, said connectors together forming a container-machine connection, such that the substrate treatment liquid can controllably flow from the reservoir via the container-machine connection to said fluid communication system; and (iii) a valve which is movable between an open and a closed position to control the flow of substrate treatment liquid from the storage container, said valve comprising a biasing member such that the valve is biased toward an open or closed position within the housing; and wherein the reservoir, container connector and valve comprise a recyclable plastic, and that the biasing member comprises a recyclable plastic has a shore A hardness of 30-95 degrees, preferably 40-90 degrees, more preferably 45-85 degrees.

With the arrangement of the invention, recyclable container once empty can be recycled into current recycling streams established for petroleum-derived resins (e.g. HDPE, PET, PP) or paper without compromising the suitability of recycled resin for use in remaking components. The Shore A hardness confers the advantage that the spring provides an effective biasing force so that piston is retained either in the open or closed condition which is vital to prevent leakage or unwanted closure hence under/over dosing.

Container

The container may take any form, but preferably it is rigid. It may comprise a rigid box construction.

Preferably any seals which are not recyclable plastic e.g. rubber, are located on the container connector and not on the reservoir. This means that the reservoir can be recycled as a plastic, without including contaminating non-plastic material such as rubber.

The container is designed to be fluidly connectable with a machine connector of the substrate treatment machine and comprises a valve which is movable between an open and a closed position to control the flow of substrate treatment liquid from the storage container. With regard to the container, if rigid, it preferably comprises an air inlet valve, so that as liquid is removed, during dosing when the container is installed, air can be drawn into the reservoir to replace the lost liquid. The air inlet preferable comprises the same material as the reservoir. The air inlet valve preferably allows the passage of air therethrough, but prevents, by appropriate aperture size, substrate treatment liquid to pass through.

Valve

Preferably the valve is housed in or on the container connector. Preferably the valve comprises a reservoir closure member which is movable between an open position allowing egress of composition from the reservoir; and a closed position in which egress is prevented.

Reservoir Closure Member

The reservoir closure member may be movable within a housing and the housing comprising one or more apertures opening into the reservoir. The housing may be located within the reservoir externally of the reservoir but is in fluid communication with the reservoir via said apertures. The closure member may be movable to open and close the housing apertures. With the apertures open, this allows a flow of the liquid to pass from the reservoir and when closed, the flow is shut off.

The valve may comprise a biasing member, such as a resilient or elastic component, e.g. spring, such that it is biased toward an open position or a closed position.

The reservoir closure member may be spring-loaded within a housing/tube. The spring may surround the reservoir closure member. The spring is preferably captive in the housing.

The housing may comprise any suitable shape e.g. a tube. The housing may comprise a cage or even a mesh.

The reservoir closure member may comprise a piston which is movable within a chamber between an open and a closed position. As the piston moves within the tube it effects opening and closing of the apertures in the tube. Preferably the apertures are present in the side of the tube. The tube may further comprise an end opening (an opening in an end portion) such that as the piston moves in the tube, an end portion of the piston exits the end opening.

Biasing Member

The biasing member is preferably in or on the container. Preferably the biasing member comprises a spring. The spring comprises recyclable plastic as herein described.

Plastic springs are not commonly used because they can suffer from irreversible, plastic deformation which is undesirable in a spring. Spring design in the context of valve operation within a substrate treatment machine requires consideration of multiple essential properties: rigidity, good fatigue resistance, load carrying capacity, minimum creep, self-lubricity, corrosion resistance and ease of processing into the desired shape. Thus it is not simply a matter of moulding a plastic spring in the image of a metal predecessor. However, we have found that with the design and materials specified herein, plastic springs can be incorporated to facilitate a fully recyclable container.

The biasing means may comprise any suitable construction and may comprise a coil or helical spring, a leaf spring, a zig-zag spring or curved beam spring or a tubular e.g generally cylindrical spring to replicate the action of a coil spring.

The cylindrical spring may comprise flexible beams to achieve greater stiffness than molded coil springs.

Preferably the spring comprises a compression spring and this compression spring may be compressed to open or close the valve. However, tension springs are also possible.

Preferably the biasing means/spring comprises a hollow body which surrounds the reservoir closure member. Preferably the hollow body is generally tubular and co-axially aligned with the reservoir closure member thus forming a sleeve around the reservoir closure member. The hollow body may incorporate an end taper or base plate which is attaches or abuts the reservoir closure member as it opens/closes so that one or both actions are against the bias (the compression/tension force of the spring).

Preferably the body comprises a circumferential wall which is solid. By "solid" is meant that the body at rest (not under compression or tension) does not have any helical apertures as are found with e.g. helical springs, and preferably there are no apertures.

The hollow body may be elastic at least longitudinally (along the longitudinal axis) by virtue of the elasticity of the material and/or the shape. The hollow body may be shaped to comprise one or more, preferably 1-20, more preferably 2-10, even more preferably 3-7 radial bulges or radial recesses which provide elasticity. The radial bulges/recesses may be formed on the exterior and/or interior of the tubular body. That is to say, the bulge may be achieved by an increase in wall thickness and, similarly, the recess may be achieved by a decrease in wall thickness. Alternatively or additionally, the bulge/recess may be achieved by the profile of the wall itself, so that, in cross section, an external bulge provides an internal recess.

The spring circumferential wall preferably has a thickness of 1-4 mm, preferably 1.1 mm to 2 mm, more preferably 1.1-1.65 mm.

Preferably the hollow body of the spring comprises an elastic material having a shore A hardness of 30-95 degrees, preferably 40-90 degrees, more preferably 45-85 degrees. Hardness testing may be conducted using a shore hardness meter. The hardness is measured by the depth of indentation caused by a rigid ball under a spring the indentation being converted to hardness degrees on a scale ranging from 0 to 100. The spring-loaded meter gives Shore A values. The hardness scale from 0 to 100 is chosen such that '0' represents a rubber having an elastic modulus of zero and '100' represents a rubber having infinite elastic modulus.

The hollow body may be formed by any suitable process, for example injection molding to form an integral piece. The hollow body may comprise end portions shaped as a circular truncated cones.

Preferably the undulating hollow wall, comprises depressions (visible when the hollow body is viewed from the side) having an angle 95° to 165°.

Advantageous elasticity for biasing a reservoir closure member (piston) in a substrate container in a washing machine is determined a combination of (i) the pressure angle range 95° to 165°; and (ii) the number of recesses/bulges being 1-20, preferably 2-10, more preferably 3-7; and (iii) the thickness of 1-8 mm, preferably 1.1 mm to 4 mm, more preferably 1.1-1.65 mm.

Preferably the hollow body comprises a thermoplastic polymer, preferably a polyolefin selected from polyethylene or polypropylene.

In the case of coiled, helical compression springs, preferably it comprises an end coil at each of the two opposing ends of the spring. Preferably the end coils are substantially closed having a pitch angle of zero where pitch is the axial distance between coils. Preferably the end coils lie against the load bearing (end) surfaces of the tube portion even before compression.

Preferably the or each end coil is followed by a respective active transmission coil of varying pitch. Preferably, in between the transition coils are 1 to 5, preferably 1-3 full pitch coils of constant pitch. References herein and in the claims to "coils" refer to either "full coils" or segments" of full coils. Preferably, in between the transition coils are 1 to 20, preferably 2 to 14 more preferably 3-10 full pitch active coils of constant pitch. The transition coil maximizes the square/flat load bearing surface of the end coil while maintaining a smooth kink-free design in which stress points are minimized and allows for injection mold separation after formation. Preferably, the end coils are each squared, closed and gradually tapered in thickness from the point at which the end coil is connected to the transition coil towards the free end of the end coil. The end coils are squared and tapered towards their ends to minimize side thrust and maximize flat load bearing surfaces without creating stress points or increasing the solid height of the spring, again accounting for manufacturability. This reduces the amount of material needed to manufacture the spring.

Preferably the cross-section of the coils of the spring is substantially rectangular and preferably trapezoidal, decreasing in height from the inside out. This maximizes the amount of active material. The slight outward tapering of the rectangular cross-section facilitates manufacturability.

Preferably the spring has a spring rate in the range 0.4-5.25 N/mm, more preferably 1-4 N/mm most preferably 2-3 N/mm. Spring rate is a measure of the stiffness of a spring and is defined as the force (N) needed to compress the spring 1 mm. It is preferred that the spring rate is linear. Preferably the free length of the spring is between 10-100 mm, more preferably 20-60 mm.

Recyclable Plastic

The reservoir comprises a recyclable plastic.

The container connector and valve (including housing, reservoir closure member and most preferably the biasing member/spring) may also comprise a recyclable plastic.

Preferably the recyclable plastic comprises a common class of plastics that can be recycled together to provide a useable output from recycling i.e. can be recycled to provide recycled material for packaging or device construction. This allows for the device to be recycled without dismantling by the consumer.

More preferably, the recyclable plastic comprises a single recyclable plastic. This can provide a more usable output from recycling.

The plastic preferably comprises a thermoplastic polymer, to allow for remoulding after recycling. The plastic may comprise polyethylene terephthalate (PET), polypropylene e.g. linear low density polyethylene (LLDPE), low density polyethylene (LDPE), high density polyethylene (HDPE); polyethylene terephthalate, polypropylene, or polyetherimide (PEI), polyoxymethylene (POM), polyamide (PA), ABS, nylon, acetal, and polyphenylene sulphide.

As used in herein, the term "class" in terms of plastics, means a class of plastics based on polymer behaviour during recycling. One such class is polyolefins such as PE and/or PP which can be recycled together as mixed polyolefins, the output of which can be widely used as a secondary material source. PE/PP blends can even be upgraded or 'upcycled' by adding unblended recycled PP. Therefore devices made entirely from PP (preferably HDPE) and/or PE can be 100% recyclable.

Reservoirs may comprise a closure which is attachable to protect the valve but detachable so it can be removed before installation of the cartridge in the machine. Preferably, in the case of attachable closure, this also comprises a recyclable plastic, most preferably the same plastic material as the other components. In this way, when the article is recycled, and consumers do so by replacing the closure, the entire article remains recyclable. In the case of closures which cannot be re-attached, it is preferable that this a recyclable material, not necessarily plastic because consumers may dispose of separately.

Preferably the plastic is recycled: and may be a mix of post-consumer recycled plastic or post-industrial recycled plastic or regrind or mixtures thereof.

As used herein, "recyclable" refers to the ability of the components of an article (e.g. bottle, cap, labels) to enter into current recycling streams established for petroleum-derived resins (e.g. HDPE, PET, PP) or paper without compromising the suitability of recycled resin for use in remaking components.

As used herein, "regrind" material is thermoplastic waste material, such as sprues, runners, excess parison material, and reject parts from injection and blow molding and extrusion operations, which has been reclaimed by shredding or granulating. Recycled mixed polyolefins (rMPO), are defined as any mix of polyolefins and may comprise a mix of polyethylene (PE) and polypropylene (PP). The plastic may comprise bio plastic. Bio plastic may be derived from any suitable renewable biomass source such as vegetable fats and oils, corn starch, straw, woodchips, sawdust, recycled food waste, agricultural by-products.

Preferably (at least a portion) of the packaging/device comprises a recycled material. Preferably the recycled material is selected from the group consisting of post-consumer recycled material (PCR), post-industrial recycled material (PIR), regrind and mixtures thereof. Preferably the packaging/device comprises at least 10 wt. %, preferably at least 25 wt. %, more preferably at least 50 wt. %, even more preferably at least 75 wt. %, for example, at least 90 wt. % or about 100 wt. % of recycled material.

Preferably the recycled material comprises a recycled polymer e.g. plastic. The recycled material may comprise a mixture of polymers. The packaging may comprise different recycled materials for different parts, such as a bottle and cap, and said different parts may comprise different polymers, and at least one part comprises a recycled material.

The recycled polymer may be selected from the group consisting of post-consumer recycled polyethylene (PCR-PE), post-industrial recycled polyethylene (PIR-PE), ocean plastic, regrind polyethylene and any mixture thereof. Preferably the PE is high density (HDPE).

Alternatively, or additionally the polymer may be selected from the group consisting of post-consumer recycled polypropylene (PCR-PP), post-industrial recycled polypropylene (PIR-PP), and a mixture thereof;

Alternatively, or additionally the polymer may be selected from the group consisting of post-consumer recycled polyethylene terephthalate (PCR-PET), post-industrial recycled polyethylene terephthalate (PIR-PET), regrind polyethylene terephthalate, and a mixture thereof; or a polymer selected from the group consisting of a post-consumer recycled polyester of furan dicarboxylic acid, a post-industrial recycled polyester of furan dicarboxylic acid, a regrind polyester of furan dicarboxylic acid, and a mixture thereof; with the proviso that (i) and (ii) are either both PET or both a polyester of furan dicarboxylic acid.

The reservoir may comprise at least 10 wt. % of a polymer having a biobased content of at least 90%, based on the total weight of the reservoir. Preferably the biobased polymer corresponds to the recycled polymer, for example if the recycled polymer is PE, then likewise the polymer having bio-based content is also PE preferably HDPE.

The recycled material may comprise one or more performance modifiers to maintain performance. Recycling processing can degrade materials, especially where recycled materials are entering a second or third life. Repeated exposure to heat, light and processing can degrade mechanical properties e.g. impact resistance. Thus, the recycled material may incorporate one or more performance modifiers. Such performance modifiers may comprise impact modifiers (to improve impact resistance) and/or process modifiers (to make processing easier) e.g. nucleating agents/crystallization additives. Examples of impact modifiers include Dow AFFINITY™ (i.e., polyolefin plastomer), Exxon Mobil VISTAMAXX™ (i.e., polypropylene based elastomer), and KRATON® from GLS (i.e., styrenic based block-copolymer/elastomer), any of which can vary in the level of saturation of the olefinic portion. The impact modifier can be derived wholly or partially from recycled material.

As used herein, "recyclable" refers to the capability of components to undergo current recycling processes whereby the recycled output can be used for making e.g. packaging or devices.

As used herein and unless otherwise noted, "polyethylene" encompasses high density polyethylene (HDPE), low density polyethylene (LDPE), linear low density polyethylene (LLDPE), and ultra low density polyethylene (ULDPE).

As used herein and unless otherwise noted, "polypropylene" encompasses homopolymer polypropylene, random copolymer polypropylene, and block copolymer polypropylene.

Spring Material

The spring also preferably comprises plastic. Preferably the spring comprises a thermoplastic with spring or rubber-elastic properties. For springs, particularly suitable materials include polymers polyacetal, polyoxymethylene (POM), polyamide (PA), polyethylene (PE), polypropylene (PP), polyester, ABS, nylon, acetal, and polyphenylene sulphide, or polyetherimide (PEI), polyether ether ketone (PEEK), polycarbonate.

Polyolefins are preferred, especially polyethylene and/or polypropylene and especially when the other components of the container comprise either or both these materials.

With regard to any plastics used, preferably they are substantially free of chemical components which would compromises recycling. This is especially the case where all the components are a common plastic e.g. PP or PE—allowing the device to be recycled as a single unit. In this case all components are preferably substantially free of chemical components which would otherwise prevent the cartridge being recycled without dismantling and separating. So for example all the components could be PP or they could be PE.

As used herein, the terms "substantially free of" or "substantially free from" mean that the indicated material is at the very minimum not deliberately added to the composition/material to form part of it, or, preferably, is not present at analytically detectable levels. It is meant to include materials or composition whereby the indicated material is present only as an impurity in one of the other materials deliberately included.

Spring Setting

Advantageously, the spring is designed and arranged so that it is unloaded (relaxed to its free length) or at least the load reduced substantially (spring is at least partially decompressed) when the valve is shut e.g. when in transit or storage and then it is under the greatest load in compression whilst the valve is open, when the cartridge is installed in the washing machine and the substrate treatment product is to be dispensed (e.g. drawn by a pump). This ensures that the spring is under the minimum load during transit, to preserve resistance to creep. This is especially advantageous for polyethylene and polypropylene, which are less resistant to creep than fortified/modified but less practically recyclable polymers.

Most preferably, the spring may be a plastic compression spring which is compressed to open the valve and decompressed to its free length to close the valve.

Washing Machine

Preferably the washing machine comprises a suds container arranged in a housing and a drum, rotatably mounted inside the suds container, for receiving the laundry items to be treated, and comprises at least one recyclable container as defined above. The machine has a connecting line for the flow of substrate treatment composition from the storage container to the suds container.

The machine (as part of the machine connector, or fluid lines) preferably comprises a valve actuator for actuating (i.e. moving to open and/or closed position) the valve of the recyclable storage container.

The valve actuator may comprises a fluid communication member, which is connected or connectable to or integral with a fluid communication line of the washing machine. Preferably, the fluid communication member. The fluid communication line is preferably connected to a suds container of the washing machine, such that, when the storage container is installed in the washing machine, substrate treatment composition can flow from the storage container, via the machine-container connection to the fluid communication line and then on to the suds container where is can flow into the drum for treating laundry articles placed therein.

The valve actuator is preferably hollow to allow the passage of fluid therethrough. It may be tubular and elongate such that valve actuation is achieved by insertion of the valve actuator into a recess in the container connection e.g. to access the reservoir closure member/piston.

Actuation is preferably by engagement of the valve actuator with the reservoir closure member/piston, so as to move said reservoir closure member/piston to the open position, in order to allow the additive to flow out of the storage container through the tube portion and through the hollow member into to the connecting line.

The valve actuator may comprise a closure, such as a cap, sleeve, seal etc to prevent flow from the fluid connection line of the washing machine, when the storage container is not installed.

Substrate

Preferably the substrate is any suitable substrate including substrate, substrate articles, garments, bedding, towels etc., and dishes, where "dishes" is used herein in a generic sense, and encompasses essentially any items which may be found in a dishwashing load, including crockery chinaware, glassware, plasticware, hollowware and cutlery, including silverware.

Treatment

Preferably treatment includes washing, treating with rinse additives, conditioning, softening, cleaning, stain removal, scrubbing, refreshment, freshening, bleaching, disinfecting, anti-malodour etc.

Substrate Treatment Composition

Preferably the cartridge stores multiple doses of the substrate treatment composition.

The substrate treatment composition may comprise any compositions or formulations of a liquid form that are designed for cleaning soiled material. Such compositions may include, but are not limited to, laundry cleaning compositions, fabric softening compositions, fabric enhancing compositions, fabric freshening compositions, laundry prewashing compositions, laundry pretreating compositions, laundry additives (e.g., rinse additives, wash additives, etc.), post-rinse fabric treatment compositions, dry cleaning compositions, ironing aid, dish washing compositions, hard surface cleaning compositions, and other suitable compositions that may be apparent to one skilled in the art in view of the teachings herein.

Preferably the substrate treatment composition is a liquid or gel with a high-shear viscosity of at least 100 mPa/s when measured at 20 degrees C. at a relatively high shear rate of about 20 $s^{-1}$. This prevents the substrate treatment liquid being excessively thin/runny when it is dispensed by the machines's automatic dosing device from the cartridge into the machine's cleaning chamber (e.g. suds container) at a high operating flow rate (e.g. about 0.1-10 ml/second) and a high operating shear rate (e.g. about 10-250 $s^{-1}$) which might lead to some of the liquid seeping past plastic seals.

Preferably the high shear viscosity does not exceeding 500 mPa/s when measured at 20 degrees C. at a relatively high shear rate of about 20 $s^{-1}$ as this could compromise the ability of any pumps to function.

More preferably the high-shear viscosity is in the range 150-350 mPa/s when measured at 20 degrees C. at a relatively high shear rate of about 20 $s^{-1}$.

As used herein, the term "automatic dosing device" may be a flow meter, a pump, a valve, a pipe, or any other device that is suitable for automatic dosing of a substrate treatment composition.

As used herein, the term "high-shear viscosity" refers to the viscosity of the liquid detergent composition of the present invention when measured at atmospheric temperature (i.e., 20° C.) and a relatively high shear rate of about 20 $s^{-1}$. Specifically, the viscosity can be measured by a Brookfield DV-II+ Pro Viscometer. In this measurement, the liquid detergent sample is controlled at 20° C. via a water bath (Model MPG-20C). A SC4-31 spindle is selected and set at a rotation speed of about 12 rotation per minute (RPM), which is appropriate for viscosity measurement between 15 mPa·s and 300,000 mPa·s at the shear rate of 20 $s^{-1}$.

The term "operating flow rate" refers to the volumetric flow rate of the liquid detergent composition through the automatic dosing device when such device is operating, i.e., actively dispensing the liquid detergent composition. Such operating flow rate is calculated as D/T wherein D is the single dose of liquid detergent composition dispensed by the automatic dosing device, and wherein T is the dosing time. For example, when the automatic dosing device automatically dispenses a single dose of 50 ml of the liquid detergent composition within a dosing time of 20 seconds, the operating flow rate is about 2.5 ml/second.

The term "operating shear rate" refers to the shear rate at the inner wall of the liquid detergent composition (which is assumed to be a Newtonian fluid) within the pipe of the automatic dosing device when such device is operating, i.e., actively dispensing the liquid detergent composition. Such operating shear rate is calculated as $Y=8\ v/d$ where wherein y is the shear rate, measured in reciprocal seconds, v is the linear fluid velocity, and d is the inside diameter of the pipe. The linear fluid velocity v is further calculated as $D/(T\times\pi\times(d/2)^2)$ so the operating shear rate is correspondingly calculated as $Y=32\times D/(T\times\pi\times(d/2)^2)$. For example, when the automatic dosing device has a pipe diameter of 5 mm and automatically dispenses a single dose of 25 ml of the liquid detergent composition within a dosing time of 20 seconds, the operating shear rate is about 102 $s^{-1}$. If an automatic dosing device contains multiple pipes of different inner diameters, then the smallest inner diameter is used to calculate the operating shear rate for purpose of the present invention.

An non-limiting example of the invention is shown purely schematically in the drawings and will be described in more detail below.

Figure 2A:
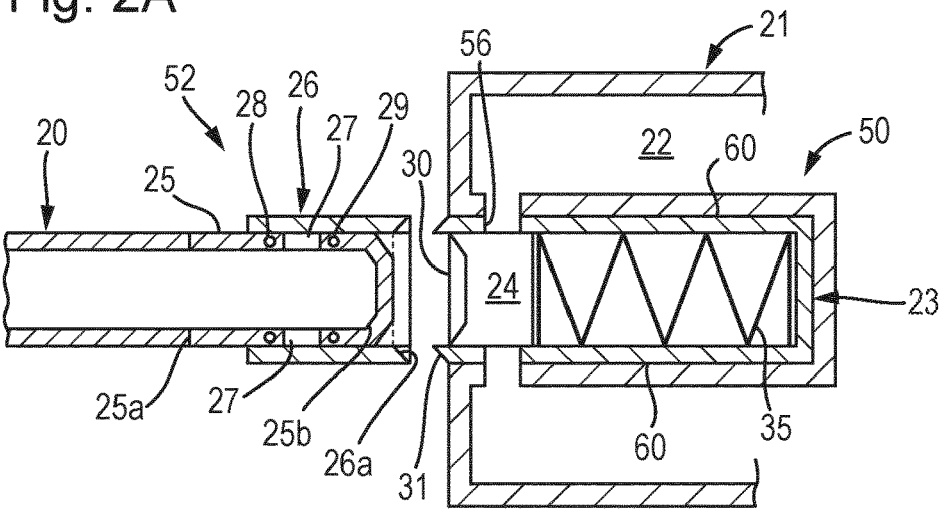
Figure 2B:
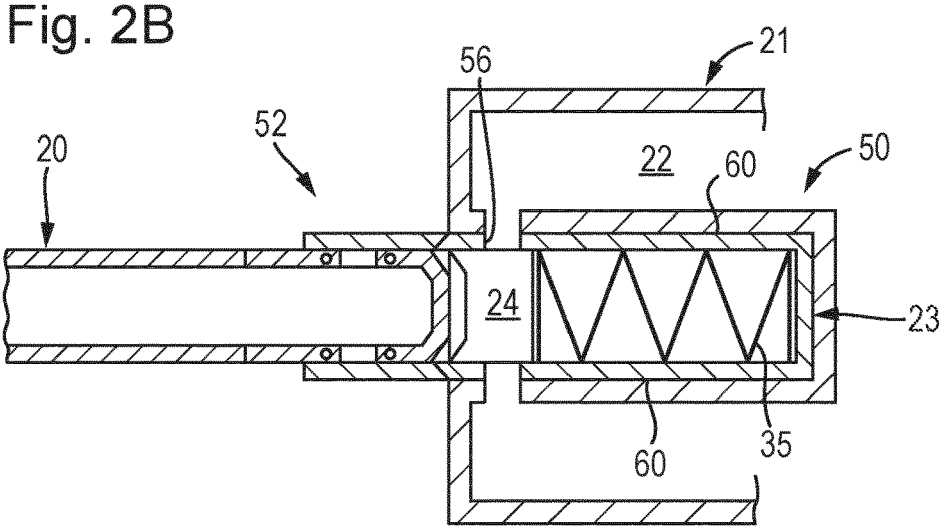
Figure 2C:
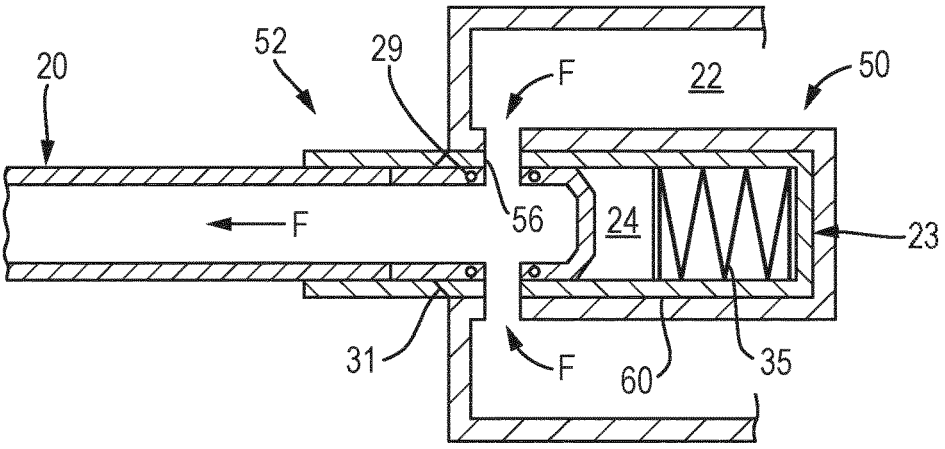
Figure 3A:
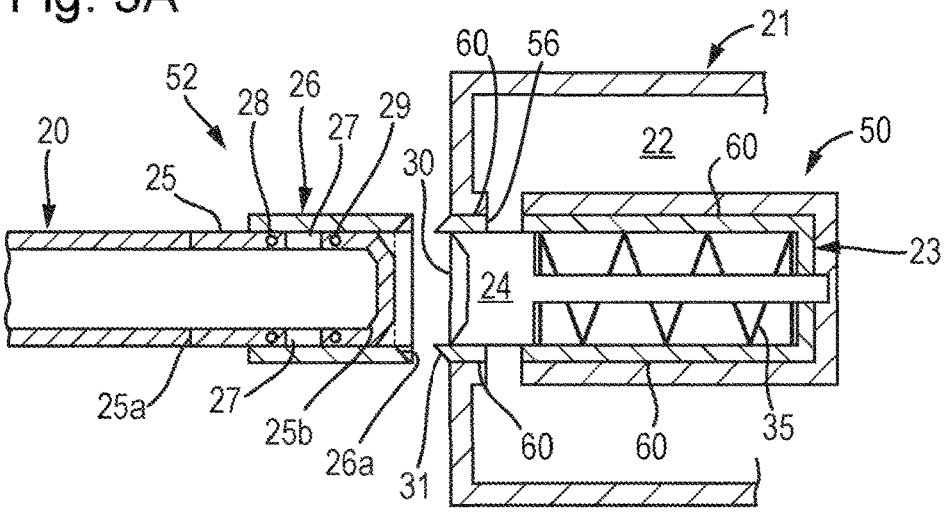
Figure 3B:
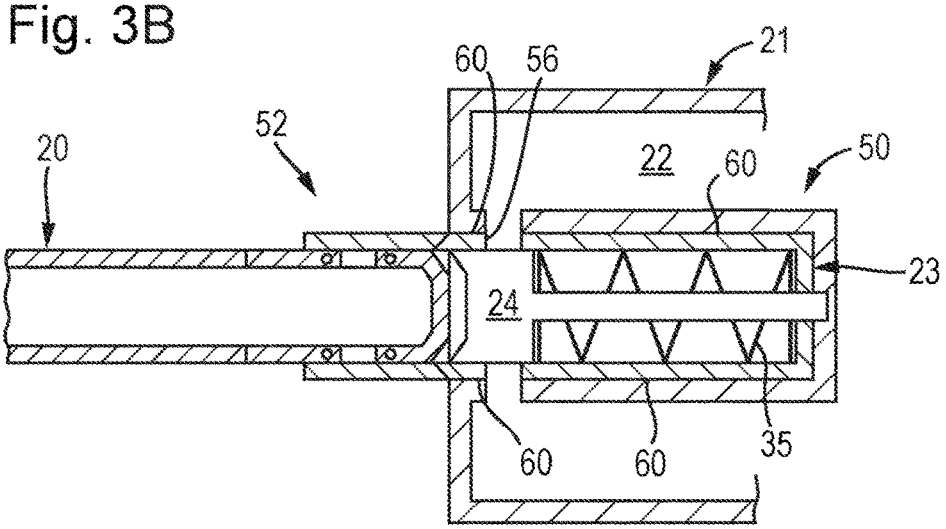
Figure 3C:
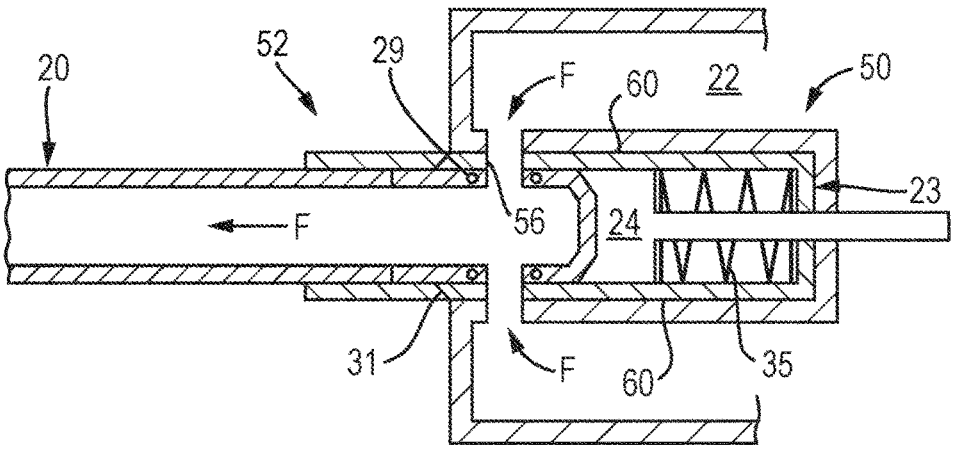
Figure 4A:
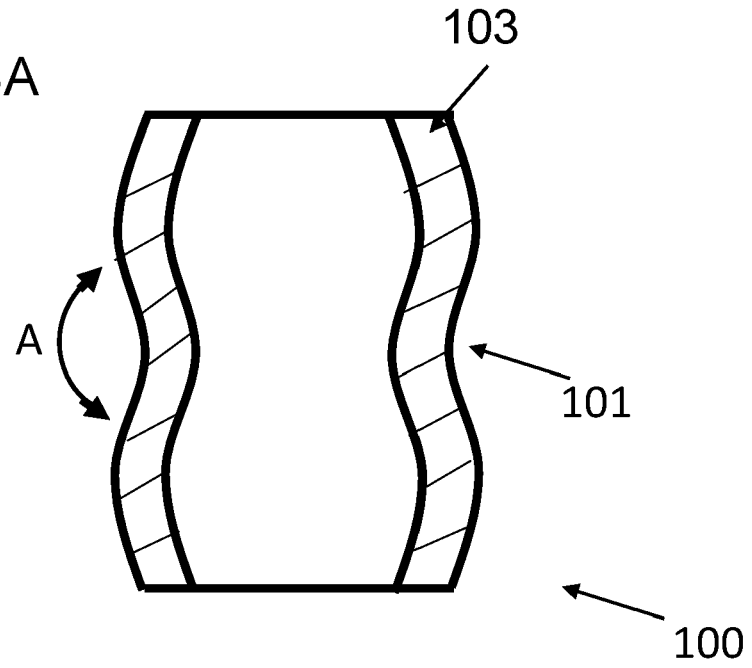
Figure 4B:
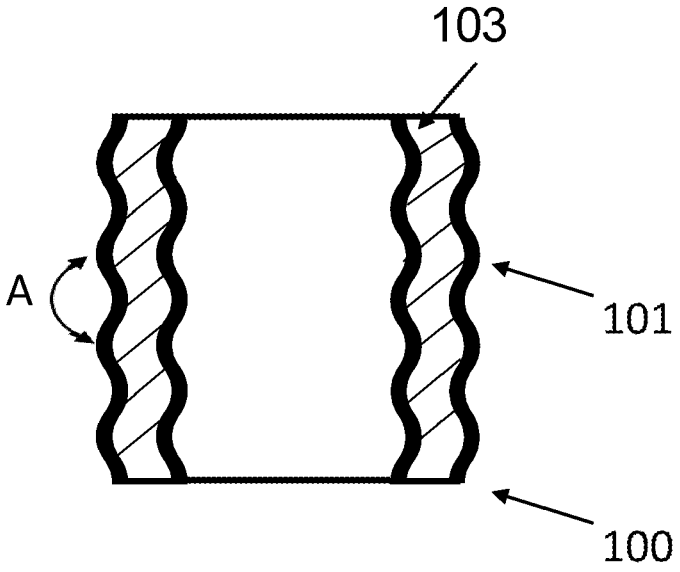

FIG. 1: is a schematic of a recyclable cartridge installed in a washing machine;

FIGS. 2*a*-2*c* are magnified schematics of the machine-cartridge connection of the recyclable cartridge of FIG. 1, in varying positions;

FIGS. 3*a*-3*c*: are magnified schematics of another example of a machine-cartridge connection that would work with the machine of FIG. 1, comprising an alternative cartridge connector, again in varying positions;

FIGS. 4*a*,4*b*: are magnified schematics of an alternative biasing member for use in the recyclable container of FIG. 1 and any container of the invention In FIG. 1 shows a purely schematic representation of an auto-dosing washing machine 1. The machine comprises the conventional arrangement of a perforated drum 3 rotatably mounted in a suds container 2 within an outer housing 4. Drum 3 is driven by an electric motor (motor, electronics not shown but is well known to those skilled in the art) to rotate and agitate laundry items therein. Laundry is loaded into the drum 3 via opening, closable by door 5. Machine 1 further comprises, a heater not shown, operative to heat the washing liquid in the suds container 2.

The machine 1 comprises a water feed pipe 14 fluidly connected to the dispensing drawer 11 such that water can be fed from a water supply, into the machine to flow along the pipe via drawer 11 and then into the suds container 2 and thence into the drum 3. Manual dosing can be effected by loading treatment composition/s into the drawer 11. This is then flushed into the suds container 2 and drum 3. Below tub 2 is drain device 12, for draining spent laundry liquids/rinse water 19 to a drain line, connected to a main drain/sewer. A control device 18 controls the washing machine processes including inlet valve (not shown), drain device 12, drive motors, electronics and heater etc as with conventional washing machines with which the skilled person will be aware.

The washing machine 1 further comprises an automatically controlled metering device 8 comprising a bay 15 and fluid connection attachments for one or more recyclable substrate treatment containers 21 (only one shown, installed). In the embodiments shown, a recyclable treatment container 21 is loaded. The recyclable container 21 contains liquid substrate treatment composition 22 (such as liquid detergents, washing additives or flushing additives, such as fabric softeners as described herein).

The metering device 8 comprises a pump 17, which under control of device 18, pumps the substrate treatment composition 22 to the suds container 2 via a flexible fluid connecting line 20. Containers 21 can be pushed into/pulled out of the bay via an opening in a front wall or side wall of the housing 4. There may be one or more containers, and these may be moved individually or in groups or all together.

FIGS. 2*a*-2*c* show magnified views of the container-machine connection 16 which comprises a container connector 50, being fluidly connectable with a machine connector 52 of the washing machine 1. This connection 16 allows the substrate treatment liquid 22 to controllably flow from the reservoir via the container-machine connection to the fluid communication line 20.

The container connector comprises a valve comprising a spring-loaded piston 24 which is movable between an open and a closed position to control the flow (F) of substrate treatment liquid from the storage container 21 into line 20. The spring comprises a plastic compression spring 35 which is axially aligned with the piston 24. Preferably the spring has a spring rate in the range 0.4-5.25 N/mm, more preferably 1-4 N/mm most preferably 2-3 N/mm. Spring rate is a measure of the stiffness of a spring and is defined as the force (N) needed to compress the spring 1 mm. It is preferred that the spring rate is linear. Preferably the free length of the spring is between 10-100 mm, more preferably 20-60 mm.

In FIG. 2*a* the reservoir 21 is shown separated from the connection line 20. The machine connector 52 comprises a hollow shaft 25 attached, in-line and in fluid communication with connecting line 20 on a first side 25*a*. The opposite side 25*b* of the shaft 25 has openings 27 on the side of the shaft and carries a sleeve 26, which in the position shown, overlies to close the openings 27. Ring seals 28, 29 are mounted on the hollow shaft 25 in front and behind openings 27 to prevent leakage once the piston is in the open position (see FIG. 2*c* and also 3*c*).

The storage container 21 comprises, a container connection 50. This comprises a cylindrical tube section 23 which is inside the reservoir and in fluid communication therewith via apertures in the side of the tube 23. The tube 23 encloses the spring loaded piston 24. The piston 24 is shown in the closed position so that the apertures 56 in the tube are blocked by the piston. The spring loading of the piston is by means of a plastic compression spring 35 and the piston is located centrally and axially of the spring 35. The spring 35 is held captive in the tube 23.

The tube section 23 opens into port 30 on the outside. The edge 31 of the port 30 is shaped e.g. tapered or chamfered to mirror the edges of the port, so that the free end 26*a* of the sleeve 26 can when inserted, be centred on the port to ensure a good connection.

FIG. 2*b* shows the container-machine connection 16, in which the reservoir is inserted so far into the bay of device housing 4, that the edge 26*a* of the sleeve 26 abuts the edge 31 of the port 30. The valve is in this position is still closed, since the openings 27 remain covered by sleeve 26. Also, the valve in the container 21, which is formed by the cylindrical tube section 23 and the piston 24 is still closed because the piston 24 remains in a position blocking (closing) apertures.

FIG. 2*c* shows the container-machine connection 16 with the valve open. The shaft 25 has been moved sufficiently far into the tube section 23 of the container that the openings 27 are in fluid connection with the reservoir via apertures 56 of tube 23 to allow the flow of the treatment composition from the reservoir 21 to the connection line 20. The seal 29 prevents leakage to the outside. Preferably the seals are plastic.

At this position, the sleeve 26 is pushed back so that the end of shaft 25 can be inserted into the tube section 23. When separating the connection, so when pulling out of the reservoir 21*a*, the port edge 31 is the last component separated from the sleeve 26.

As outlined in FIG. 1, a pump 17 may be used to convey the substrate. substrate treatment composition. The amount and the timing of the dosage are controlled by the control device 18 of the washing machine 1. The separation of a container 21 from the mandrel and the connecting line 20 takes place in the reverse order. For machines where multiple containers can be installed, the principle of the machine-container connection as explained herein applies to the other containers.

FIGS. 3*a*-3*c* show an identical embodiment, but in this case the piston 24 extends axially into the tube 23 and exits the distal end of the tube through an aperture. With this arrangement, as the piston moves in the direction of the reservoir, its distal end actually enters the reservoir via the aperture in the tube section 23.

The recyclable container including the container connector and all components including the spring 35 comprises a recyclable plastic, preferably it comprises all polypropylene (PP,), or all polyethylene (PE) preferably high density polyethylene (HDPE), or any combination thereof.

In both embodiments described above, the spring 35 comprises a helical compression spring 35 and is arranged so that the compression spring 35 is compressed to open the valve and decompresses as the valve closes. The spring 35 has two ends, one end is seated against the piston and the opposite (distal) end of the spring 35 is seated against the periphery of the base of the tube section 23. The spring 35 comprises an end coil at each of the two opposing ends of the spring. Preferably the spring 35 comprises an end coil at each end of the spring 35. The end coils are substantially or completely closed having a pitch angle of zero where, wherein pitch is defined as the axial distance between coils.

The end coils lie against the load bearing (end) surfaces of the tube portion even before compression. The end coils are sized to abut against the load bearing (inner end) surfaces of the tube portion 23 even before compression with the piston in the closed position. With the design in FIGS. 3*a*-3*c*, the aperture in the base of the tube 23 and the end coil are relatively sized so that each end coil is completely supported by the inner end surface and does not overhang the aperture.

Each end coil is be followed by a respective active transmission coil of varying pitch. There are 2 or more transition coils of constant pitch. References herein and in the claims to "coils" refer to either "full coils" or segments" of full coils. The end coils may be squared, closed and gradually tapered in thickness from the point at which the end coil is connected to the transition coil towards the free end of the end coil. The end coils are squared and tapered towards their ends to minimize side thrust and maximize flat load bearing surfaces without creating stress points or increasing the solid height of the spring. Preferably the cross-section of the coils of the spring is substantially rectangular and preferably trapezoidal, decreasing in height from the inside out. In between the transition coils are 1 to 5, preferably 1-3 full pitch coils of constant pitch. References herein and in the claims to "coils" refer to either "full coils" or segments" of full coils. In between the transition coils are 1 to 20, preferably 2 to 14 more preferably 3-10 full pitch active coils of constant pitch. The end coils are each squared, closed and gradually tapered in thickness from the point at which the end coil is connected to the transition coil towards the free end of the end coil. The end coils are squared and tapered towards their ends to minimize side thrust and maximize flat load bearing surfaces without creating stress points or increasing the solid height of the spring 35, again accounting for manufacturability. In between the transition coils are 10 full pitch coils of constant pitch. The cross-section of the coils of the spring 35 is substantially rectangular and preferably trapezoidal. The spring coils decrease in height from the inside out (radially) to provide a slight outward tapering of the rectangular cross-section facilitates manufacturability.

Also in both embodiments, the container connector is detachable from the reservoir by means of screw threaded attachment 60. This is achieved by mutually engaging screw threads on the reservoir and container connector. Also included are one or more seals, which are housed on the container connector to ensure a leak-proof connection.

FIGS. 4*a* and 4*b* shows an alternative to the above spring comprising a solid walled biasing member 100, comprising an elongate hollow body 101 and co-axially aligned forming a sleeve around the piston (not shown in FIGS. 4*a* and 4*b*). The hollow body 100 comprises a circumferential, 103 comprising a thermoplastic polymer either polypropylene or polyethylene and is elastic by virtue of one or more, preferably 1-20, more preferably 2-10 longitudinal radial bulges. The spring circumferential wall preferably has thickness of 1-8 mm, preferably 1.1 mm to 4 mm, more preferably 1.1-1.65 mm.

The hollow body of the spring comprises polypropylene or polyethylene having a Shore A hardness of 30-95 degrees, preferably 40-90 degrees, more preferably 45-85 degrees. Testing may be conducted using a shore hardness meter. The hardness is measured by the depth of indentation caused by a rigid ball under a spring the indentation being converted to hardness degrees on a scale ranging from 0 to 100. The spring-loaded meter gives Shore A values. The hardness scale from 0 to 100 is chosen such that '0' represents a rubber having an elastic modulus of zero and '100' represents a rubber having infinite elastic modulus.

The hollow body may be formed by any suitable process, for example injection molding of sections (which may be of a single or different materials) to form an integral piece. The hollow body may comprise end portions shaped as a circular truncated cones.

Preferably the wall comprises depressions (visible when the hollow body is viewed from the side) having an angle A in the range from 95° to 165°.

Advantageous elasticity for biasing a reservoir closure member (piston) in a substrate container in a washing machine is determined by (i) the pressure angle in range from 95° to 165°;

(ii) the number of bulges/recesses being in the range from 1-20, preferably 2-10, more preferably 3-7; and (iii) the thickness in the range from 1-8 mm, preferably 1.1 mm to 4 mm, more preferably 1.1-1.65 mm.

Preferably the hollow body comprises a thermoplastic polymer, preferably a polyolefin selected from polyethylene or polypropylene.

Preferably any seals which are not recyclable plastic e.g. rubber, are located on the container connector and not on the reservoir. This means that the reservoir can be recycled as a plastic, without including contaminating non-plastic material such as rubber.

The container is designed to be fluidly connectable with a machine connector of the substrate treatment machine and comprises a valve which is movable between an open and a closed position to control the flow of substrate treatment liquid from the storage container.

With regard to the container, if rigid, it preferably comprises an air inlet valve, so that as liquid is removed, during dosing when the container is installed, air can be drawn into the reservoir to replace the lost liquid. The air inlet preferable comprises the same material as the reservoir. The air inlet valve preferably allows the passage of air therethrough, but prevents, by appropriate aperture size, substrate treatment liquid to pass through.

Once the recyclable container is empty, it may be placed in its entirety into the plastic recycling.

The invention claimed is:

1. A recyclable container containing a substrate treatment liquid, configured for fluid connection to a fluid communication system of a substrate treatment machine, the container comprising:

(i) a reservoir containing a multi-dose stock of the substrate treatment liquid;

(ii) a container connector which is designed to be removably and fluidly connectable with a machine connector of the substrate treatment machine, said connectors together forming a container-machine connection, such that the substrate treatment liquid can controllably flow from the reservoir via the container-machine connection to said fluid communication system; and (iii) a valve which is movable between an open and a closed position to control the flow of substrate treatment liquid from the container, said valve comprising a biasing member such that the valve is biased toward an open or closed position within a housing;

wherein the reservoir, container connector and valve comprise a recyclable plastic and that the biasing member comprises a recyclable plastic having a shore A hardness of 30-95 degrees, wherein the biasing member is under load whilst the valve is open and the substrate treatment product dispensed, and then it is unloaded (relaxed to its free length) when the valve is shut.

2. The recyclable container according to claim 1 wherein the recyclable plastic of one or more of the reservoir, container connector, valve and biasing member comprises a thermoplastic polymer.

3. The recyclable container according to claim 2 wherein the thermoplastic polymer comprises a polyolefin.

4. The recyclable container according to claim 1 wherein the reservoir, container connector and valve comprise a common recyclable plastic being a polypropylene (PP) or polyethylene (PE).

5. The recyclable container according to claim 1 wherein the biasing member comprises a spring.

6. The recyclable container according to claim 5 wherein the spring comprises a hollow body with a solid circumferential wall comprising one or more radial bulges or recesses.

7. The recyclable container according to claim 6 wherein the number of bulges or recesses is in range from 1-20.

8. The recyclable container containing a substrate treatment liquid according to claim 1 wherein the recyclable plastic of one or more of the reservoir, container connector, valve and biasing member comprises a bio-plastic.

9. The recyclable container containing a substrate treatment liquid according to claim 1 wherein the recyclable plastic of one or more of the reservoir, container connector, valve and biasing member comprises recycled plastic.

10. The recyclable container containing a substrate treatment liquid according to claim 1 wherein the valve comprises a piston and tube, the piston being movable within the tube.

11. The recyclable container according to claim 1 wherein the substrate treatment machine is a washing machine.

12. The recyclable container according to claim 1 wherein the biasing member comprises a recyclable plastic having a shore A hardness of 40-90 degrees.

* * * * *